US008904989B2

(12) United States Patent
Matsuo et al.

(10) Patent No.: US 8,904,989 B2
(45) Date of Patent: Dec. 9, 2014

(54) LUBRICATION STRUCTURE FOR HYBRID TYPE VEHICLE POWER UNIT

(75) Inventors: Kenji Matsuo, Saitama (JP); Kenichi Nakano, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 898 days.

(21) Appl. No.: 12/711,487

(22) Filed: Feb. 24, 2010

(65) Prior Publication Data

US 2010/0229824 A1 Sep. 16, 2010

(30) Foreign Application Priority Data

Mar. 12, 2009 (JP) ..... 2009-060011

(51) Int. Cl.

| | |
|---|---|
| ***F02N 15/02*** | (2006.01) |
| ***F02N 11/00*** | (2006.01) |
| *F01M 1/02* | (2006.01) |
| *F01M 1/12* | (2006.01) |

(52) U.S. Cl.

CPC ..... *F01M 1/02* (2013.01); *F01M 2001/0215* (2013.01); *F01M 2001/0269* (2013.01); *F01M 2001/123* (2013.01); *F02N 15/02* (2013.01); *F02N 11/003* (2013.01)

USPC ..... 123/196 R; 123/179.25

(58) Field of Classification Search

CPC ..... F02N 15/02; F02N 15/003; F02N 11/003; F02N 11/04; F02N 11/06

USPC ..... 123/196 R, 179.25, 179.28, 179.29

See application file for complete search history.

(56) References Cited

U.S. PATENT DOCUMENTS

| | | | | |
|---|---|---|---|---|
| 6,386,170 | B1 * | 5/2002 | Iwano et al. | 123/196 R |
| 6,443,263 | B1 * | 9/2002 | Ito et al. | 184/6.5 |
| 2007/0111849 | A1 * | 5/2007 | Ji | 477/6 |
| 2009/0013952 | A1 * | 1/2009 | Deniston et al. | 123/179.28 |
| 2009/0069146 | A1 * | 3/2009 | Soga | 476/3 |
| 2009/0321157 | A1 * | 12/2009 | Sowul et al. | 180/65.22 |
| 2010/0065001 | A1 * | 3/2010 | Spicer et al. | 123/179.28 |

FOREIGN PATENT DOCUMENTS

| | | | |
|---|---|---|---|
| JP | 2000-046166 | A | 2/2000 |
| JP | 2001-106149 | A | 4/2001 |
| JP | 2001-280458 | A | 10/2001 |
| JP | 2003-294120 | A | 10/2003 |

* cited by examiner

*Primary Examiner* — Lindsay Low
*Assistant Examiner* — Jacob Amick
(74) *Attorney, Agent, or Firm* — Birch, Stewart, Kolasch & Birch, LLP

(57) ABSTRACT

In a hybrid type vehicle power unit including a first oil pump interlockingly connected to a crankshaft so as to supply at least a lubricating oil to an engine and a transmission, and a second oil pump for supplying the lubricating oil to the transmission, it is not necessary for an electric motor to be exclusively used for the second oil pump. Thus, a reduction in the number of component parts and a reduction in the cost of manufacturing are achieved. The second oil pump is interlockingly connected to an electric motor capable of transmitting a driving torque to an output shaft through the transmission.

22 Claims, 4 Drawing Sheets

LUBRICATION STRUCTURE FOR HYBRID TYPE VEHICLE POWER UNIT

CROSS-REFERENCE TO RELATED APPLICATIONS

The present application claims priority under 35 USC 119 to Japanese Patent Application No. 2009-060011 filed on Mar. 12, 2009 the entire contents of which are hereby incorporated by reference.

BACKGROUND OF THE INVENTION

1. Field of the Invention

The present invention relates to a hybrid type vehicle power unit including an engine having an engine body with a crankcase for rotatably bearing a crankshaft, a transmission accommodated in the crankcase so as to be interposed between the crankshaft and an output shaft which is rotatably borne on the crankcase so as to be connected with a drive wheel. An electric motor is mounted on the engine body so as to permit transmission of a driving torque to the output shaft through the transmission. A first oil pump is interlockingly connected to the crankshaft so as to supply at least a lubricating oil to the engine and the transmission. The first oil pump is disposed on the engine body. A second oil pump is disposed on the engine body so as to supply the lubricating oil to the transmission. More specifically, the invention relates to an improvement in a lubrication structure.

2. Description of Background Art

A structure is known wherein an electrically driven second oil pump is provided in addition to a first oil pump interlockingly connected to a crankshaft wherein oil discharged from the first and second oil pumps is led to an oil pressure operating device through a change-over conducted by a change-over mechanism. See, for example, Japanese Patent Laid-Open No. 2001-280458.

As set forth in Japanese Patent Laid-Open No. 2001-280458, however, the second oil pump is driven by an electric motor for exclusive use, which leads to an increase in the number of component parts and an increase in the cost of construction.

SUMMARY AND OBJECTS OF THE INVENTION

According to an embodiment of the present invention, a lubrication structure for a hybrid type vehicle power unit is provided wherein an electric motor for exclusive use for a second oil pump is not necessary. Thus, the number of component parts is reduced, thereby achieving a reduction in cost.

According to an embodiment of the present invention, a hybrid type vehicle power unit includes an engine having an engine body with a crankcase for rotatably bearing a crankshaft, a transmission accommodated in the crankcase so as to be interposed between the crankshaft and an output shaft which is rotatably borne on the crankcase so as to be continuous with a drive wheel and an electric motor mounted to the engine body so as to permit transmission of a driving torque to the output shaft through the transmission. A first oil pump is interlockingly connected to the crankshaft so as to supply at least a lubricating oil to the engine and the transmission. The first oil pump is disposed on the engine body. A second oil pump is disposed on the engine body so as to supply the lubricating oil to the transmission. The second oil pump is interlockingly connected to the electric motor.

According to an embodiment of the present invention, change-over means is provided wherein a transmission lubricating oil passage for leading the lubricating oil to the transmission is made to communicate with the first oil pump when the first oil pump is operated and wherein the transmission lubricating oil passage is made to communicate with the second oil pump when the first oil pump is not operated and are changed over from one to the other according to an output oil pressure of the first oil pump.

According to an embodiment of the present invention, an on-off valve closed in a condition wherein a driving torque of only the electric motor is transmitted to the output shaft is provided between the first oil pump and a transmission lubricating oil passage for leading the oil from the second oil pump to the transmission.

In addition, a starter motor 34, a selector valve or change-over means 108, and a solenoid-controlled on-off valve 115 are provided.

According to an embodiment of the present invention, the second oil pump is driven by the electric motor capable of imparting a driving torque to the output shaft. Therefore, an electric motor for exclusive use for the second oil pump is unnecessary. Thus, it is possible to reduce the number of component parts to achieve a reduction in cost. Moreover, in an assisted running condition in which the electric motor is used and in a condition where the vehicle is driven by only the driving force of the electric motor, the transmission can be supplied with a lubricating oil from the second oil pump. Therefore, the transmission can be lubricated reliably even when the crankshaft is not rotated.

According to an embodiment of the present invention, the condition where the oil from the first oil pump is led to the transmission and the condition where the oil from the second oil pump is led to the transmission are changed over from one to the other by the change-over means for performing a change-over operation according to the output oil pressure of the first oil pump. Therefore, while eliminating the need for a special change-over control, the oil from the second oil pump can be led to the transmission side while preventing the oil from uselessly flowing to the engine side in the condition where the vehicle is driven by only the driving force of the electric motor.

According to an embodiment of the present invention, in the condition where the vehicle is driven by only the driving force of the electric motor, the oil from the second oil pump can be prevented from uselessly flowing to the engine side, by closing the on-off valve which is provided between the first oil pump and the transmission lubricating oil passage for leading the oil from the second oil pump to the transmission.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
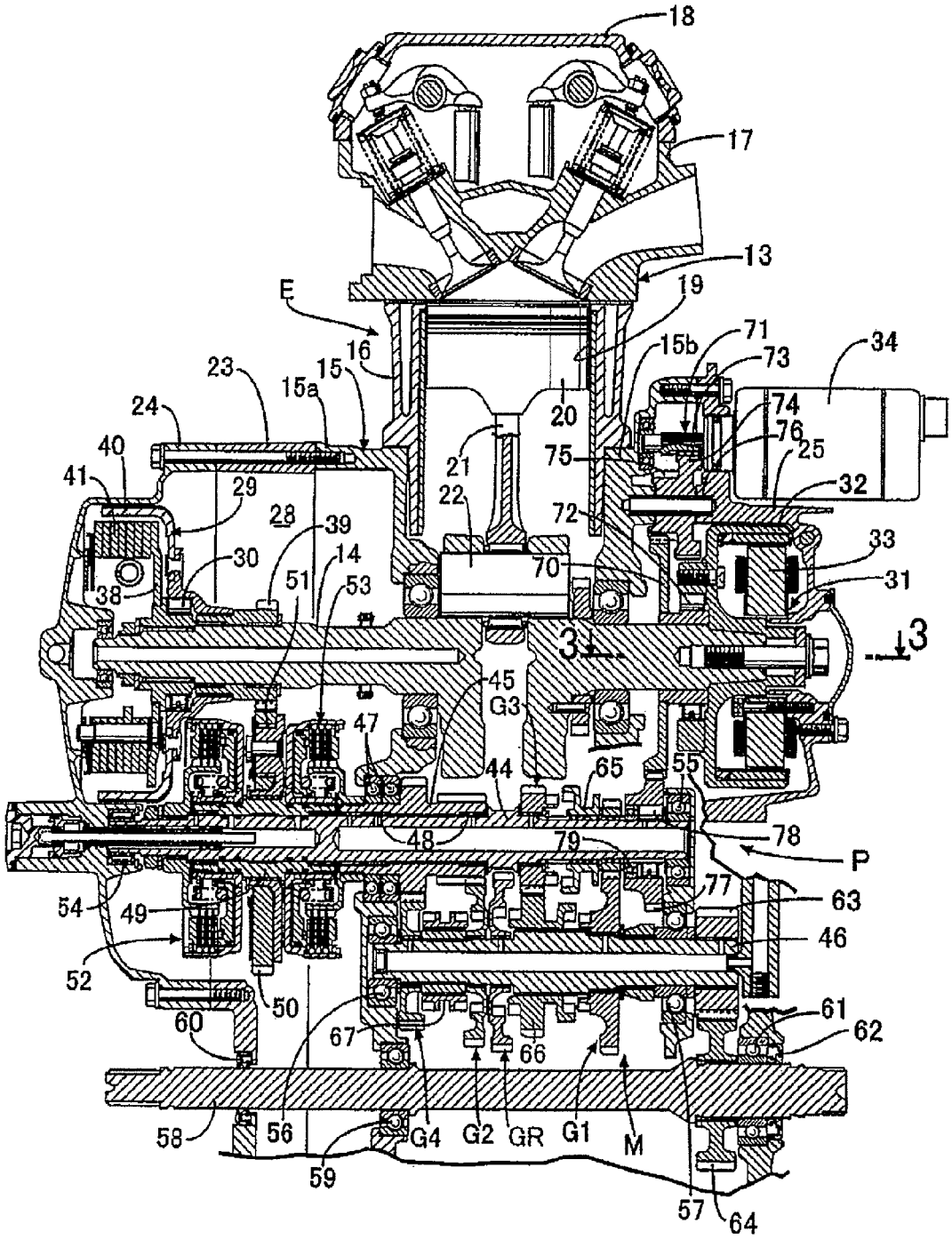
FIG. 1 is a longitudinal sectional view of a power unit according to Example 1.

Now, embodiments of the present invention will be described below, based on the accompanying drawings.

Referring to FIGS. 1 to 4, Example 1 of the present invention will be described. First, in FIG. 1, this power unit P has an engine E and a transmission M, and is mounted on a vehicle, for example, an all-terrain vehicle (ATV). An engine body 13 of the engine E includes a crankcase 15 for rotatably bearing a crankshaft 14 having an axis set along the front-rear direction, a cylinder 16 connected to an upper portion of the crankcase 15, a cylinder head 17 connected to an upper portion of the cylinder 16, and a head cover 18 connected to an upper portion of the cylinder head 17. A piston 20 is slidably fitted in a cylinder bore 19 of the cylinder 16 and is connected to the crankshaft 14 through a connecting rod 21 and a crank pin 22.

The crankcase 15 is composed of a pair of case halves 15*a* and 15*b* coupled to each other at a plane orthogonal to the rotational axis of the crankshaft 14. First and second crankcase covers 23 and 24 are fastened to one side of the crankcase 15 so that the first crankcase cover 23 is clamped between the second crankcase cover 24 and the case half 15*a*. A third crankcase cover 25 is fastened to the other side of the crankcase 15. A clutch accommodation chamber 28 is formed between the crankcase 15 and the second crankcase cover 24. The first to third crankcase covers 23, 24 and 25 also constitute part of the engine body 13.

One end of the crankshaft 14 which protrudes from the crankcase 15 is rotatably borne on the second crankcase cover 24. A centrifugal clutch 29 accommodated in the clutch accommodation chamber 28 is mounted to one end portion of the crankshaft 14 at a position close to the second crankcase cover 24, through a one-way clutch 30. A rotor 32 of a generator 31, disposed between the crankcase 15 and the third crankcase cover 25, is connected to another end portion of the crankshaft 14 which protrudes from the crankcase 15, whereas a stator 33 of the generator 31 is fixed to the third crankcase cover 25. In addition, a starter motor 34, which is an electric motor, is mounted to the third crankcase cover 25 in such a manner so as to have a rotational axis parallel to the crankshaft 14.

The centrifugal clutch 29 includes a drive plate 38 fixed to the crankshaft 14, a cup-shaped clutch housing 40 which coaxially covers the drive plate 38 so as to be rotated together with a drive gear 39 relatively rotatably mounted on the crankshaft 14, and a clutch weight 41 turnably borne on the drive plate 38 so as to be capable of frictional engagement with the inner periphery of the clutch housing 40 according to the action of a centrifugal force attendant on the rotation of the crankshaft 14. In addition, a one-way clutch 35 is provided between the clutch housing 40 and the drive plate 38 so as to permit transmission of a back torque from the drive gear 39 to the crankshaft 14.

The transmission M wherein gear trains for a plurality of gear speeds which can be selectively established, for example, a reverse gear train GR and forward gear trains for a plurality of speeds, for instance, first-speed to fourth-speed gear trains G1 to G4 are provided between first and second main shafts 44, 45 and a counter shaft 46, is accommodated in the crankcase 15. The first main shaft 44, the second main shaft 45 and the counter shaft 46 are disposed so as to have respective axes parallel to the crankshaft 14. The first and second main shafts 44 and 45 are coaxially disposed so as to be capable of relative rotation about the same axis. The first-speed gear train G1 and the third-speed gear train G3 are provided between the first main shaft 44 and the counter shaft 46, whereas the second-speed gear train G2, the fourth-speed gear train G4 and the reverse gear train GR are provided between the second main shaft 45 and the counter shaft 46. The reverse gear train GR is composed of a drive gear in the second-speed gear train G2, a reverse idle gear (not shown) having an input-side gear portion meshing with this drive gear, and a driven gear which is rotatably borne on the counter shaft 46 and meshes with an output-side gear portion of the reverse idle gear.

In addition, the first main shaft 44 penetrates, coaxially and in a relatively rotatable manner, the second main shaft 45 which is rotatably borne on the crankcase 15 through ball bearings 47, 47. A plurality of needle bearings 48 are interposed between the second main shaft 45 and the first main shaft 44. In addition, one-end portion of the first main shaft 44 is rotatably borne on the second crankcase cover 24 through a roller bearing 54, and another-end portion of the first main shaft 44 is rotatably borne on the crankcase half 15*b* of the crankcase 15 through a ball bearing 55. Furthermore, one-end portion of the counter shaft 46 is rotatably borne on the case half 15*a* of the crankcase 15 through a ball bearing 56, and another-end portion of the counter shaft 46 penetrates the case half 15*b* of the crankcase 15 in a rotatable manner, with a ball bearing 57 interposed between the counter shaft 46 and the case half 15*b*.

In the clutch accommodation chamber 28, a power transmission tubular shaft 49 is relatively rotatably mounted on the first main shaft 44. Rotational power from the crankshaft 14 is transmitted to the power transmission tubular shaft 49 through the centrifugal clutch 29, the drive gear 39, a driven gear 50 meshing with the drive gear 39, and a rubber damper 51. In addition, a first hydraulic clutch 52 as a power transmission change-over mechanism for change-over between power transmission from the crankshaft 14 to the first main shaft 44 and cutoff of the power transmission is provided between the power transmission tubular shaft 49 and the first main shaft 44. In addition, a second hydraulic clutch 53 for change-over between power transmission from the crankshaft 14 to the second main shaft 45 and cutoff of the power transmission is provided between the power transmission tubular shaft 49 and the second main shaft 45.

When the first hydraulic clutch 52 is in a power transmitting state and power is transmitted from the crankshaft 14 to the first main shaft 44, power is transmitted from the first main shaft 44 to the counter shaft 46 through an alternatively established one of the first-speed and third-speed gear trains G1 and G3. When the second hydraulic clutch 53 is in a power transmitting state and power is transmitted from the crankshaft 14 to the second main shaft 45, power is transmitted from the second main shaft 45 to the counter shaft 46 through an alternatively established one of the second-speed, fourth-speed and reverse gear trains G2, G4 and GR.

In addition, a one-side portion of an output shaft 58 connected to a drive wheel (not shown) and having an axis parallel to the rotational axis of the crankshaft 14 penetrates the case half 15*a* on one side of both the case halves 15*a* and 15*b* of the crankcase 15 and the first crankcase cover 23 in a rotatable manner, whereas an other-side portion of the output shaft 58 penetrates the third crankcase cover 25 in a rotatable manner. A ball bearing 59 is interposed between the case half 15*a* and the output shaft 58, an annular seal member 60 is interposed between the first crankcase cover 23 and the output shaft 58, and a ball bearing 61 and an annular seal member 62 are interposed between the third crankcase cover 25 and the output shaft 58.

On the other hand, a drive gear 63 is fixed to an end portion of the counter shaft 46 which protrudes from the case half 15*b* on the other side of both the case halves 15*a* and 15*b* of the crankcase 15, and a driven gear 64 meshing with the drive gear 63 is provided on the output shaft 58. In other words, the counter shaft 46 is connected to the drive wheel through the drive gear 63, the driven gear 64 and the output shaft 58.

A first shifter 65 is borne on the first main shaft 44 in the transmission M in a relatively non-rotatable and axially slidable manner. Second and third shifters 66 and 67 are borne on the counter shaft 46 in a relatively non-rotatable and axially slidable manner. A condition of establishing the first-speed gear train G1, a condition of establishing the third-speed gear train G3 and a condition of establishing the reverse gear train GR can be alternatively changed over by the first and second shifters 65 and 66. A condition of establishing the second-speed gear train G2 and a condition of establishing the fourth-speed gear train G4 can be changed over by the third shifter 67.

A speed reducing gear train 71 including a starter driven gear 70 relatively rotatably borne on the crankshaft 14 and a starting one-way clutch 72 interposed between the starter driven gear 70 and the crankshaft 14 so as to permit power transmission from the starter driven gear 70 to the side of the crankshaft 14 are provided between the starter motor 34, which is mounted to the third crankcase cover 25 of the engine body 13, and the crankshaft 14.

The speed reducing gear 71 is composed of a starter drive gear 73 provided on an output shaft of the starter motor 34, a first idle gear 74 meshing with the starter drive gear 73, a second idle gear 75 formed integrally with the first idle gear 74, and the starter driven gear 70 meshing with the second idle gear 75. Both end portions of a support shaft 76 supporting the first and second idle gears 74 and 75, formed as one body, are supported by the case half 15*b* of the crankcase 15 and the third crankcase cover 25.

A power transmitting gear 77 is relatively rotatably borne on the first main shaft 44 in the transmission M through a running one-way clutch 78, which is provided for permitting power transmission to the side of the first main shaft 44, and a ball bearing 79. The power transmitting gear 77 meshes with the starter driven gear 70.

The starter motor 34 is capable of imparting a starting torque to the crankshaft 14, and is also capable of transmitting a driving torque to the output shaft 58 through the transmission M.

The operating conditions of each part of the power unit P from the time of starting the engine E to the time of operation of the vehicle will be described sequentially. First, at the time of starting the engine E, the transmission M is set into a neutral state, the first and second hydraulic clutches 52 and 53 are each set into a power transmission cutting-off state, and the starter motor 34 is operated. As a result, the rotational power from the starter motor 34 is inputted to the crankshaft 14 through the speed reducing gear train 71 and the starting one-way clutch 72, and the rotational power is transmitted from the starter driven gear 70 in the speed reducing gear train 71 to the first main shaft 44 in the transmission M through the power transmitting gear 77 and the running one-way clutch 78. In this case, the first main shaft 44 is only rotated idly, since the transmission M is in the neutral state.

Next, at the time of idling with the rotating speed of the engine E set at, for example, about 1400 rpm, the operation of the starter motor 34 is stopped while maintaining the condition where the transmission M is in the neutral state and the first and second hydraulic clutches 52 and 53 are in the power transmission cutting-off state.

At the time of performing power assisting by the starter motor 34 during extremely low rotation with the rotating speed of the engine E set at, for example, 1400 to 1500 rpm, the first hydraulic clutch 52 is set into a power transmitting state, a gear train, e.g., the first-speed gear train G1 in the transmission M is established, and, in this condition, the starter motor 34 is operated. As a result, because of the rotating speed of the crankshaft 14 being higher than the rotating speed of the starter driven gear 70, the starting one-way clutch 72 does not transmit the rotational power of the starter driven gear 70 to the crankshaft 14, and the rotational power of the starter driven gear 70 is transmitted to the first main shaft 44 through the power transmitting gear 77 and the running one-way clutch 78. On the other hand, due to the rotation of the first main shaft 44, the drive gear 39 connected to the first main shaft 44 through the first hydraulic clutch 52, the rubber damper 51 and the driven gear 50 is also rotated, and the rotating speed of the drive gear 39 becomes higher than the rotating speed of the crankshaft 14, whereby the one-way clutch 30 is put into a locked state. Therefore, the rotational power of the crankshaft 14 is also transmitted to the first main shaft 44 through the one-way clutch 30, the drive gear 39, the driven gear 50, the rubber damper 51 and the first hydraulic clutch 52. Accordingly, the rotational power assisted by the starter motor 34 is transmitted through the first-speed gear train G1 to the counter shaft 46, and is further transmitted through the drive gear 63 and the driven gear 64, to be outputted from the output shaft 58.

At the time of performing power assisting by the starter motor 34 during low rotation with the rotating speed of the engine E set in the range of, for example, 1500 to 2500 rpm, like at the time of power assisting during the extremely low rotation mentioned above, the first hydraulic clutch 52 is set in the power transmitting state, a gear train, e.g., the first-speed gear train G1 in the transmission M is established, and, in this condition, the operation of the starter motor 34 is continued. As a result, because of the rotating speed of the crankshaft 14 being higher than the rotating speed of the starter driven gear 70, the starting one-way clutch 72 does not transmit the rotational power of the starter driven gear 70 to the crankshaft 14, and the rotational power of the starter driven gear 70 is transmitted through the power transmitting gear 77 and the running one-way clutch 78 to the first main shaft 44. On the other hand, the rotating speed of the crankshaft 14 becomes higher than the rotating speed of the drive gear 39, so that the one-way clutch 30 does not transmit power between the crankshaft 14 and the drive gear 39, but the centrifugal clutch 29 is put into sliding engagement. Therefore, the rotational power of the crankshaft 14 is transmitted through the centrifugal clutch 29 in the sliding engagement, the drive gear 39, the driven gear 50, the rubber damper 51 and the first hydraulic clutch 52 to the first main shaft 44. Accordingly, the rotational power assisted by the starter motor 34 is transmitted through the first-speed gear train G1 to the counter shaft 46, and is further transmitted through the drive gear 63 and the driven gear 64, to be outputted from the output shaft 58.

In addition, during the low rotation with the rotating speed of the engine E set in the range of, for example, 1500 to 2500 rpm, the power assisting by the starter motor 34 can also be performed by setting the second hydraulic clutch 53 into the power transmitting state and establishing the first-speed gear train G1 and the second-speed gear train G2 in the transmission M. As a result, because the rotating speed of the crankshaft 14 is higher than the rotating speed of the starter driven gear 70, the starting one-way clutch 72 does not transmit the rotational power of the starter driven gear 70 to the crankshaft 14, and the rotational power of the starter driven gear 70 is transmitted through the power transmitting gear 77 and the running one-way clutch 78 to the first main shaft 44. On the other hand, the rotating speed of the crankshaft 14 becomes higher than the rotating speed of the drive gear 39, so that the one-way clutch 30 does not transmit power between the crankshaft 14 and the drive gear 39, but the centrifugal clutch 29 is put into sliding engagement. Consequently, the rotational power of the crankshaft 14 is transmitted through the centrifugal clutch 29 in the sliding engagement, the drive gear 39, the driven gear 50, the rubber damper 51 and the second hydraulic clutch 53 to the second main shaft 45. Therefore, in addition to the power transmitted from the crankshaft 14 to the counter shaft 46 through the second-speed gear train G2, the assisting power supplied from the starter motor 34 is transmitted through the first-speed gear train G1 to the counter shaft 46, and the rotational power of the counter shaft 46 is transmitted through the drive gear 63 and the driven gear 64, to be outputted from the output shaft 58.

At the time of performing a power assisting by the starter motor 34 during normal operation with the rotating speed of the engine E set at, for example, more than 2500 rpm, like at the time of power assisting during the low rotation mentioned above, the first hydraulic clutch 52 is set into the power transmitting state, either of the first-speed and third-speed gear trains G1 and G3 in the transmission M is established, and, in this condition, the operation of the starter motor 34 is continued. As a result, because the rotating speed of the crankshaft 14 is higher than the rotating speed of the starter driven gear 70, the starting one-way clutch 72 does not transmit the rotational power of the starter driven gear 70 to the crankshaft 14, and the rotational power of the starter driven gear 70 is transmitted through the power transmitting gear 77 and the running one-way clutch 78 to the first main shaft 44. On the other hand, the rotating speed of the crankshaft 14 becomes higher than the rotating speed of the drive gear 39, so that the one-way clutch 30 does not transmit power between the crankshaft 14 and the drive gear 39, but the centrifugal clutch 29 is engaged, namely, set into a power transmitting state. Therefore, the rotational power of the crankshaft 14 is transmitted through the centrifugal clutch 29 in the power transmitting state, the drive gear 39, the driven gear 50, the rubber damper 51 and the first hydraulic clutch 52 to the first main shaft 44. Accordingly, the rotational power assisted by the starter motor 34 is transmitted through either of the first-speed and third-speed gear trains G1 and G3 to the counter shaft 46, and is further transmitted through the drive gear 63 and the driven gear 64, to be outputted from the output shaft 58.

At the time of not performing the power assisting by the starter motor 34 during the normal operation with the rotating speed of the engine E set at, for example, more than 2500 rpm, it suffices to stop the operation of the starter motor 34. In this case, the running clutch 78 does not transmit power from the first main shaft 44 being rotated by the rotational power, which is transmitted from the crankshaft 14, to the side of the power transmitting gear 77, namely, to the side of the starter motor 34.

Furthermore, at the time of driving the vehicle by only the power supplied from the starter motor 34, the first hydraulic clutch 52 is put into a power transmission cutting-off state, either of the first-speed and third-speed gear trains G1 and G3 in the transmission M is established, and, in this condition, the starter motor 34 is operated. As a result, the rotational power of the starter driven gear 70 is transmitted through the power transmitting gear 77 and the running one-way clutch 78 to the first main shaft 44, and the rotational power transmitted to the counter shaft 46 through either of the first-speed and the third-speed gear trains G1 and G3 is transmitted through the drive gear 63 and the driven gear 64, to be outputted from the output shaft 58. In this case, since the first hydraulic clutch 52 is in the power transmission cutting-off state, the rotational power of the first main shaft 44 is not transmitted to the side of the crankshaft 14.

More specifically, in the condition where the starter driven gear 70 is driven to rotate by an operation of the starter motor 34 and where the rotating speed of the power transmitting gear 77 meshing with the starter driven gear 70 is higher than the rotating speed of the first main shaft 44 rotated by the power transmitted from the crankshaft 14, rotational power can be imparted from the power transmitting gear 77 to the first main shaft 44. Consequently, driving of the vehicle by the starter motor 34 and power assisting by the starter motor 34 can be performed. Thus, the power unit P can be configured to be of a hybrid type with a simple structure, without the addition of a large number of component parts.

In addition, since the first hydraulic clutch 52 for change-over between power transmission from the crankshaft 14 to the first main shaft 44 and cutoff of the power transmission is provided between the crankshaft 14 and the first main shaft 44, a condition where the vehicle is driven by only the driving force of the starter motor 34 can be realized by putting the first hydraulic clutch 52 into the power transmission cutting-off state.

Figure 2:
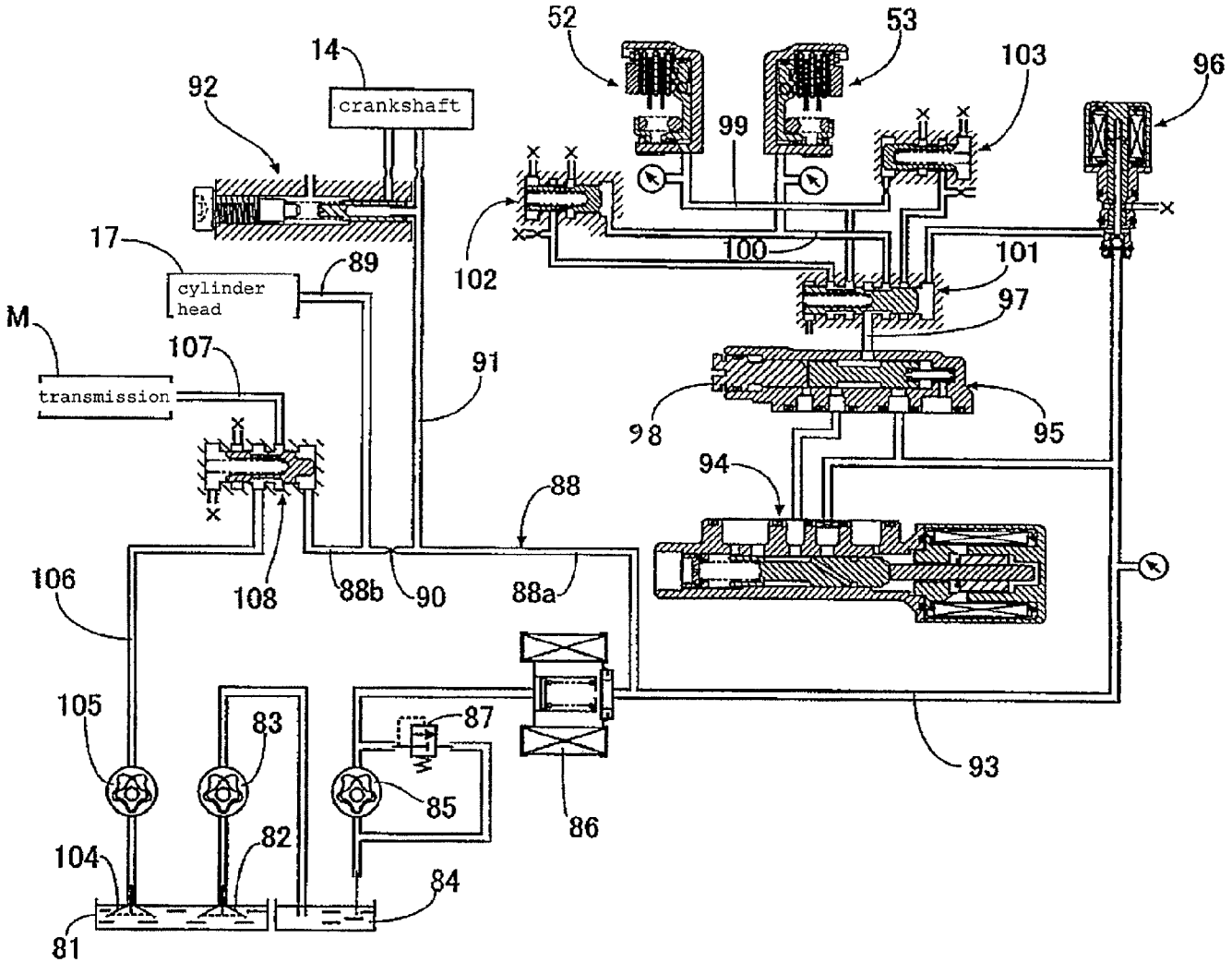
FIG. 2 is a block diagram showing an oil supply system for the power unit.

A lubrication structure for the power unit P configured to be of the hybrid type as above-mentioned will be described referring to FIG. 2. An oil reserved in an oil pan 81 connected to a lower portion of the engine body 13 is pumped up by a scavenging pump 83 through an oil strainer 82, and is supplied into an oil tank 84 disposed at the engine body 13. The oil in the oil tank 84 is pumped up by a first oil pump 85 disposed on the engine body 13 so as to be interlockingly connected to the crankshaft 14 together with the scavenging pump 83. A first oil supply passage 88 is connected to the discharge side of the first oil pump 85 through an oil filter 86, and a relief valve 87 is provided between the oil filter 86 and the suction side of the first oil pump 85.

The first oil supply passage 88 is composed of an upstream-side part 88*a* continuous with the oil filter 86, and a downstream-side part 88*b* continuous with the upstream-side part 88*a* via an orifice 90. The downstream-side part 88*b* is connected to a first lubricating oil passage 89 for leading the lubricating oil to the side of the cylinder head 17, the upstream-side part 88*a* is connected to a second lubricating oil passage 91 for leading the lubricating oil to the side of the crankshaft 14, and a variable orifice 92 is connected to an intermediate portion of the second lubricating oil passage 91. In addition, the upstream-side part 88*a* of the first oil supply passage 88 is connected to a control oil passage 93 for leading the oil for change-over control of engagement/disengagement of the first and second hydraulic clutches 52 and 53. The control oil passage 93 is connected in parallel to a linear solenoid valve 94 for controlling the oil pressure in the control oil passage 93, a selector valve 95 and a shift solenoid valve 96. At a normal time, the selector valve 95 causes an output port of the linear solenoid valve 94 to communicate with an intermediate oil passage 97. Upon failure of the linear solenoid valve 94, by a rotating operation of an operating member 98 it is possible for the selector valve 95 to cut off the communication between the linear solenoid valve 94 and the intermediate oil passage 97, and to make the control oil passage 93 communicate with the intermediate oil passage 97.

A shift valve 101 is provided between the intermediate oil passage 97 and a first clutch control oil passage 99 continuous with the first hydraulic clutch 52 as well as a second clutch control oil passage 100 continuous with the second hydraulic clutch 53. The shift valve 101 operates, with an oil pressure controlled by the shift solenoid valve 96, to perform alternative change-over between a condition where the intermediate oil passage 97 is made to communicate with the first clutch control oil passage 99 and a condition where the intermediate oil passage 97 is made to communicate with the second clutch control oil passage 100. In addition, the oil pressure in the first clutch control oil passage 99 can be released through the shift valve 101 and a first orifice control valve 102, and the oil pressure in the second clutch control oil passage 100 can be released through the shift valve 101 and a second orifice control valve 103. The oil pressure in the first clutch control oil passage 99 is released in a condition where the shift valve 101 causes the intermediate oil passage 97 to communicate with the second clutch control oil passage 100, and the oil pressure in the second clutch control oil passage 100 is released in a condition where the shift valve 101 causes the intermediate oil passage 97 to communicate with the first clutch control oil passage 99.

The oil in the oil pan 81 is pumped up also by a second oil pump 105 through an oil strainer 104. A selector valve 108 as a change-over means, by which a condition where a transmission lubricating oil passage 107 for leading the lubricating oil to the transmission M is made to communicate with the first oil pump 85 when the first oil pump 85 is operated and a condition where the transmission lubricating oil passage 107 is made to communicate with the second oil pump 105 when the first oil pump 85 is not operated are changed over from one to the other, is interposed between the second oil supply passage 106 continuous with the discharge side of the second oil pump 105 as well as the downstream-side part 88*b* of the first oil supply passage 88 and the transmission lubricating oil passage 107. Moreover, the selector valve 108 performs a change-over operation according to the output oil pressure of the first oil pump 85. The first oil supply passage 88 is made to communicate with the transmission lubricating oil passage 107 by an oil pressure applied from the first oil pump 85 when the first oil pump 85 is operated, whereas the second oil supply passage 106 is made to communicate with the transmission lubricating oil passage 107 when the first oil pump 85 is not operated.

Figure 3:
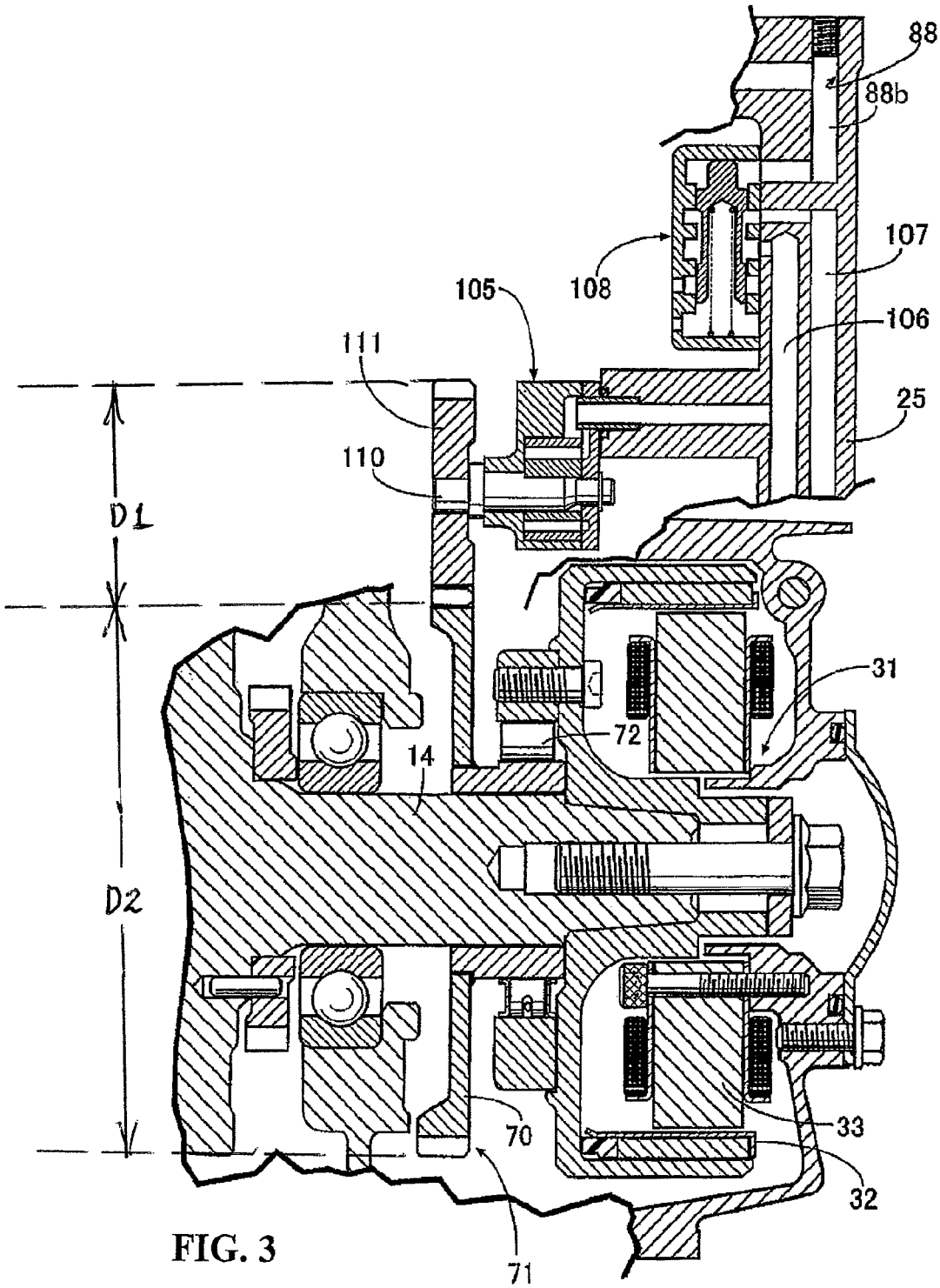
FIG. 3 is a sectional view taken along line 3-3 of FIG. 1.

In FIG. 3, the second oil pump 105 is mounted to the third crankcase cover 25 while having a pump shaft 110 parallel to the crankshaft 14. A driven gear 111 fixed to the pump shaft 110 constitutes part of the speed reducing gear train 71 provided between the starter motor 34 and the crankshaft 14, and meshes with the starter driven gear 70 which is accompanied by the starting one-way clutch 72 interposed between itself and the crankshaft 14. In other words, the second oil pump 105 is interlockingly connected to the starter motor 34, which is capable of transmitting a driving torque to the output shaft 58 through the transmission M. Driven gear 111 is fixed to the pump shaft 110 and meshes directly with a speed reducing gear 71 provided between the electric motor 34 and the crankshaft 14. The second oil pump 105 is interlockingly connected to the electric motor 34. As can be seen in FIG. 3, driven gear 111 has a diameter D1 that is sized to be less than one-half of a size of diameter D2 of the speed reducing gear 71.

The second oil supply passage 106 continuous with the discharge side of the second oil pump 105, part of the first lubricating oil passage 89 communicating with the first oil pump 85, and the transmission lubricating oil passage 107 are formed in the third crankcase cover 25, and the selector valve 108 is mounted to the inner surface of the third crankcase cover 25.

The operation of Example 1 will now be described. The starter motor 34 capable of transmitting a driving torque to the output shaft 58 through the transmission M is mounted to the third crankcase cover 25 of the engine body 13. The first oil pump 85 for supplying the engine E and the transmission M with the lubricating oil and with the oil for controlling the first and second hydraulic clutches 52 and 53 is disposed on the engine body 13 so as to be interlockingly connected to the crankshaft 14. The second oil pump 105 for supplying the transmission M with the lubricating oil is disposed at the third crankcase cover 25 of the engine body 13. Since the second oil pump 105 is interlockingly connected to the starter motor 34, an electric motor for exclusive use for the second oil pump 105 is unnecessary, which makes it possible to reduce the number of component parts and to achieve a reduction in the cost. Moreover, in an assisted running condition realized by use of the starter motor 34 and in a condition where the vehicle is driven by only the driving force of the starter motor 34, the transmission M can be supplied with the lubricating oil from the second oil pump 105, so that the transmission M can be securely lubricated even when the crankshaft 14 is not rotated.

In addition, the condition where the transmission lubricating oil passage 107 for leading the lubricating oil to the transmission M is made to communicate with the first oil pump 85 when the first oil pump 85 is operated and the condition where the transmission lubricating oil passage 107 is made to communicate with the second oil pump 105 when the first oil pump 85 is not operated can be changed over from one to the other by the selector valve 108 performing a change-over operation according to the output oil pressure of the first oil pump 85. Therefore, while eliminating the need for a special change-over control, the oil from the second oil pump 105 can be led to the side of the transmission M while preventing the oil from uselessly flowing to the side of the engine E, in the condition where the vehicle is driven by only the driving force of the starter motor 34.

Figure 4:
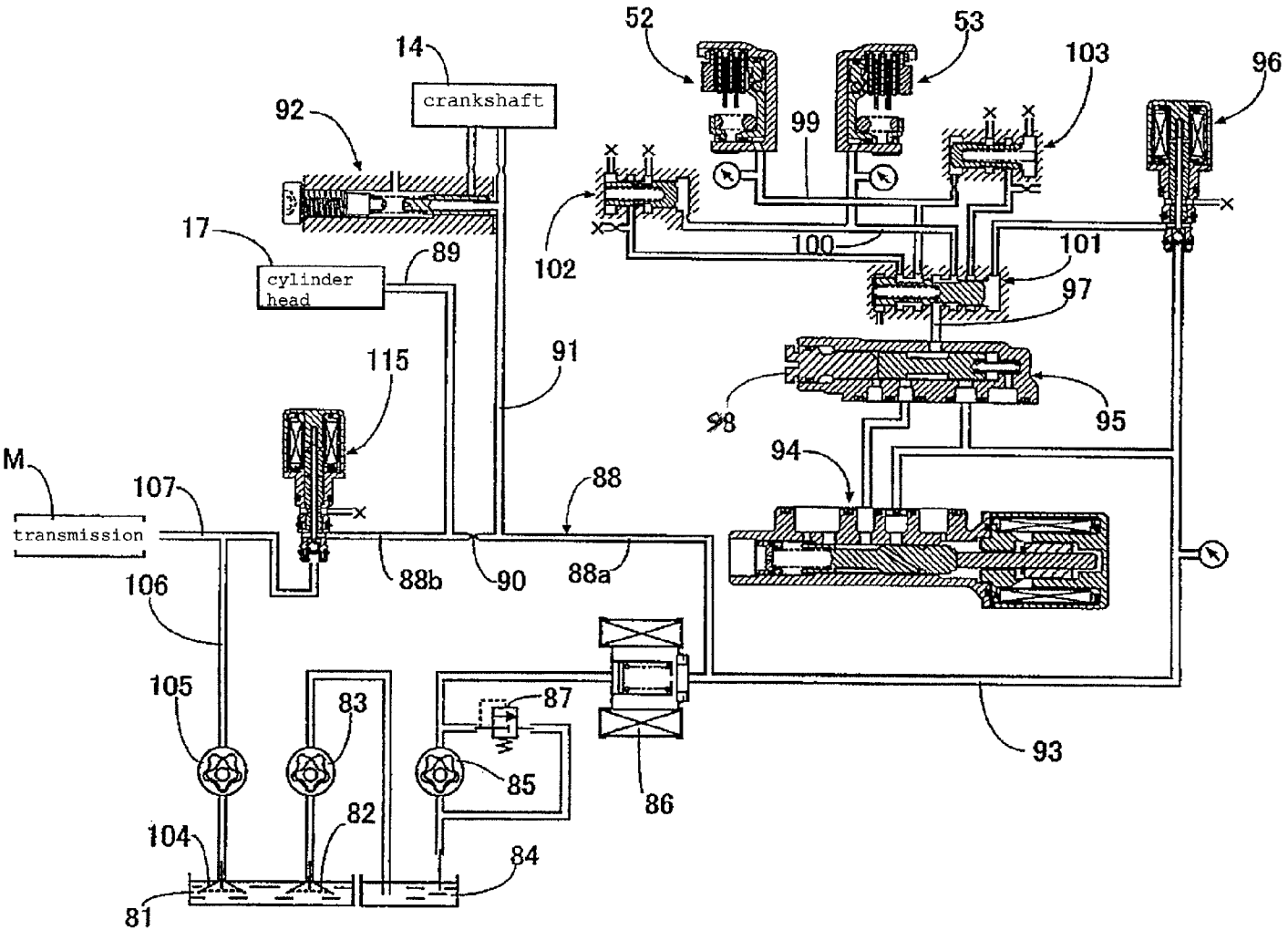
FIG. 4 is a block diagram, corresponding to FIG. 2, of Example 2.

Example 2 of the present invention will be described with reference to FIG. 4. The parts corresponding to those in Example 1 above are only shown in FIG. 4 in the state of being denoted by the same reference symbols as used above, and detailed descriptions of them are omitted.

A second oil supply passage 106 continuous with the discharge side of a second oil pump 105 constantly communicates with a transmission lubricating oil passage 107 for leading a lubricating oil to a transmission M. A solenoid-controlled on-off valve 115 is provided between the transmission lubricating oil passage 107 and a first oil supply passage 88 connected to the discharge side of a first oil pump 85 through an oil filter 86. The solenoid-controlled on-off valve 115 is controlled to be closed in a condition where the vehicle is driven by only a driving force of a starter motor 34.

According to Example 2, the oil from the second oil pump 105 can be prevented from uselessly flowing to the side of the engine E, by closing the solenoid-controlled on-off valve 115 in the condition where the vehicle is driven by only the driving force of the starter motor 34.

While the embodiments of the present invention have been described above, the invention is not limited to the above embodiments, and various design modifications are possible within the scope of the invention as described in the claims.

For instance, while the cases where the starter motor 34 for imparting a starting torque to the crankshaft 14 is used for driving the vehicle by only its driving force or for the power assisting by its driving force have been described in the above embodiments, the present invention is applicable also to the cases where an electric motor for exclusive use for hybrid mode is used.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lubrication structure for a hybrid vehicle power unit comprising:

an engine having an engine body including a crankcase for rotatably bearing a crankshaft, a transmission accommodated in the crankcase so as to be interposed between the crankshaft and an output shaft which is rotatably borne on the crankcase so as to be continuous with a drive wheel;

an electric motor mounted to the engine body for permitting transmission of a driving torque to the output shaft through the transmission; and a first oil pump interlockingly connected to the crankshaft for supplying at least a lubricating oil to the engine and the transmission and which is disposed on the engine body, and a second oil pump disposed on the engine body so as to supply the lubricating oil to the transmission;

wherein the second oil pump has a pump shaft parallel to the crankshaft, and a driven gear fixed to the pump shaft constitutes part of a speed reducing gear train provided between the electric motor and the crankshaft, whereby the second oil pump is interlockingly connected to the electric motor, wherein each of the crankshaft and the output shaft has an axis set along the front-rear direction, and the electric motor extends further in a rearward direction than each of the crankshaft and the output shaft, and wherein the speed reducing gear train includes a starter driven gear on the crankshaft.

2. The lubrication structure for the hybrid vehicle power unit according to claim 1, comprising:

change-over means by which a condition where a transmission lubricating oil passage for leading the lubricating oil to the transmission is made to communicate with the first oil pump when the first oil pump is operated, and a condition where the transmission lubricating oil passage is made to communicate with the second oil pump when the first oil pump is not operated are changed over from one to the other according to an output oil pressure of the first oil pump.

3. The lubrication structure for the hybrid vehicle power unit according to claim 1, wherein an on-off valve closed in a condition where a driving torque of only the electric motor is transmitted to the output shaft is provided between the first oil pump and a transmission lubricating oil passage for leading the oil from the second oil pump to the transmission.

4. The lubrication structure for the hybrid vehicle power unit according to claim 1, and further including an oil pan operatively connected to the second oil pump and an oil tank operatively connected to the first oil pump, wherein a scavenging pump is in communication with the oil pan and the oil tank for supplying oil from the oil pan into the oil tank.

5. The lubrication structure for the hybrid vehicle power unit according to claim 1, and further including a first oil supply passage operatively connected to an oil filter and a relief valve, wherein a discharge side of the first oil pump is in communication with the first oil supply passage for supplying oil to the engine and the transmission.

6. The lubrication structure for the hybrid vehicle power unit according to claim 5, wherein said first oil supply passage includes an upstream-side part operatively connected to a downstream side of the oil filter and a downstream-side part, wherein an orifice is disposed between the upstream-side part and the downstream-side part.

7. The lubrication structure for the hybrid vehicle power unit according to claim 6, wherein the downstream-side part of the first oil supply passage is in communication with a first lubricating oil passage for supplying oil to a side of a cylinder head.

8. The lubrication structure for the hybrid vehicle power unit according to claim 7, wherein the upstream-side part of the first oil supply passage is in communication with a second lubricating oil passage for supplying oil to a side of the crankshaft.

9. The lubrication structure for the hybrid vehicle power unit according to claim 8, and further including a variable orifice operatively connected to an intermediate portion of the second lubricating oil passage.

10. The lubrication structure for the hybrid vehicle power unit according to claim 6, and further including:

a control oil passage in communication with the upstream-side part of the first oil supply passage, said control oil passage being in communication with a change-over control for an engagement/disengagement of a first and second hydraulic clutch, said control oil passage being disposed in parallel to a linear solenoid valve for controlling an oil pressure in the control oil passage, a selector valve and a shift solenoid, wherein during normal operation, the selector valve causes an output port of the linear solenoid valve to be in communication with an intermediate oil passage and upon failure of the linear solenoid valve, by rotating an operating member the selector valve can interrupt communication between the linear solenoid valve and the intermediate oil passage for enabling the control oil passage to be in communication with the intermediate oil passage.

11. A lubrication structure for a hybrid vehicle power unit comprising:

a crankcase;

a crankshaft rotatably supported by the crankcase;

transmission accommodated in the crankcase, said transmission being interposed between the crankshaft and an output shaft, said output shaft being rotatably supported by the crankcase;

an electric motor for permitting transmission of a driving torque to the output shaft through the transmission;

a first oil pump interlockingly connected to the crankshaft for supplying at least a lubricating oil to the crankshaft and the transmission; and a second oil pump for supply the lubricating oil to the transmission;

wherein the second oil pump has a pump shaft parallel to the crankshaft, and a driven gear fixed to the pump shaft constitutes part of a speed reducing gear train provided between the electric motor and the crankshaft, whereby the second oil pump is interlockingly connected to the electric motor, wherein the driven gear fixed to the pump shaft meshes directly with a starter driven gear provided between the electric motor and the crankshaft, whereby the second oil pump is interlockingly connected to the electric motor, wherein the driven gear has a diameter D1 that is sized to be less than one-half a size of the diameter D2 of the starter driven gear.

12. The lubrication structure for the hybrid vehicle power unit according to claim 11, comprising:

change-over means by which a condition where a transmission lubricating oil passage for leading the lubricating oil to the transmission is made to communicate with the first oil pump when the first oil pump is operated, and a condition where the transmission lubricating oil passage is made to communicate with the second oil pump when the first oil pump is not operated are changed over from one to the other according to an output oil pressure of the first oil pump.

13. The lubrication structure for the hybrid vehicle power unit according to claim 11, wherein an on-off valve closed in a condition where a driving torque of only the electric motor is transmitted to the output shaft is provided between the first oil pump and a transmission lubricating oil passage for leading the oil from the second oil pump to the transmission.

14. The lubrication structure for the hybrid vehicle power unit according to claim 11, and further including an oil pan operatively connected to the second oil pump and an oil tank operatively connected to the first oil pump, wherein a scavenging pump is in communication with the oil pan and the oil tank for supplying oil from the oil pan into the oil tank.

15. The lubrication structure for the hybrid vehicle power unit according to claim 11, and further including a first oil supply passage operatively connected to an oil filter and a relief valve, wherein a discharge side of the first oil pump is in communication with the first oil supply passage for supplying oil to the engine and the transmission.

16. The lubrication structure for the hybrid vehicle power unit according to claim 15, wherein said first oil supply passage includes an upstream-side part operatively connected to a downstream side of the oil filter and a downstream-side part, wherein an orifice is disposed between the upstream-side part and the downstream-side part.

17. The lubrication structure for the hybrid vehicle power unit according to claim 16, wherein the downstream-side part of the first oil supply passage is in communication with a first lubricating oil passage for supplying oil to a side of a cylinder head.

18. The lubrication structure for the hybrid vehicle power unit according to claim 17, wherein the upstream-side part of the first oil supply passage is in communication with a second lubricating oil passage for supplying oil to a side of the crankshaft.

19. The lubrication structure for the hybrid vehicle power unit according to claim 18, and further including a variable orifice operatively connected to an intermediate portion of the second lubricating oil passage.

20. The lubrication structure for the hybrid vehicle power unit according to claim 16, and further including:

a control oil passage in communication with the upstream-side part of the first oil supply passage, said control oil passage being in communication with a change-over control for an engagement/disengagement of a first and second hydraulic clutch, said control oil passage being disposed in parallel to a linear solenoid valve for controlling an oil pressure in the control oil passage, a selector valve and a shift solenoid, wherein during normal operation, the selector valve causes an output port of the linear solenoid valve to be in communication with an intermediate oil passage and upon failure of the linear solenoid valve, by rotating an operating member the selector valve can interrupt communication between the linear solenoid valve and the intermediate oil passage for enabling the control oil passage to be in communication with the intermediate oil passage.

21. The lubrication structure for the hybrid vehicle power unit according to claim 1, wherein the second oil pump has a pump shaft parallel to the crankshaft, and a driven gear fixed to the pump shaft constitutes part of a speed reducing gear train provided between the electric motor and the crankshaft, whereby the second oil pump is interlockingly connected to the electric motor.

22. The lubrication structure for the hybrid vehicle power unit according to claim 11, wherein the second oil pump has a pump shaft parallel to the crankshaft, and a driven gear fixed to the pump shaft constitutes part of a speed reducing gear train provided between the electric motor and the crankshaft, whereby the second oil pump is interlockingly connected to the electric motor.

* * * * *